US008813706B2

(12) United States Patent
Remala et al.

(10) Patent No.: US 8,813,706 B2
(45) Date of Patent: Aug. 26, 2014

(54) INTERNAL COMBUSTION ENGINE HAVING VALVE LIFTER ASSEMBLY WITH MISALIGNMENT LIMITING KEY PIN

(75) Inventors: Satish Remala, Peoria, IL (US); Jonathan R. Chittenden, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 166 days.

(21) Appl. No.: 13/460,052

(22) Filed: Apr. 30, 2012

(65) Prior Publication Data

US 2013/0284130 A1 Oct. 31, 2013

(51) Int. Cl.
*F01L 1/14* (2006.01)

(52) U.S. Cl.
USPC ..... 123/90.5; 123/90.52

(58) Field of Classification Search
CPC ..... F01L 1/20; F01L 1/22; F01L 1/24
USPC ..... 123/90.52, 90.48, 90.5
See application file for complete search history.

(56) References Cited

U.S. PATENT DOCUMENTS

| | | | | |
|---|---|---|---|---|
| 3,886,808 | A | 6/1975 | Weber | |
| 4,724,804 | A | 2/1988 | Wirth | |
| 5,022,356 | A | 6/1991 | Morel, Jr. et al. | |
| 5,088,455 | A | 2/1992 | Moretz | |
| 5,263,386 | A | 11/1993 | Campbell et al. | |
| 6,357,407 | B2 | 3/2002 | Brothers | |
| 6,474,279 | B2 | 11/2002 | Faria | |
| 6,736,097 | B2 | 5/2004 | Riley | |
| 6,866,014 | B2 | 3/2005 | Spath | |
| 6,932,041 | B1 | 8/2005 | Riley | |
| 6,978,752 | B2 | 12/2005 | Albertson et al. | |
| 6,994,064 | B2 | 2/2006 | Haas et al. | |
| 7,007,651 | B2 * | 3/2006 | Spath | 123/90.5 |
| 7,121,244 | B2 | 10/2006 | Roe et al. | |
| 7,210,437 | B2 | 5/2007 | Geyer | |
| 2006/0016406 | A1 | 1/2006 | Geyer | |
| 2010/0294219 | A1 | 11/2010 | Prokop | |

FOREIGN PATENT DOCUMENTS

| | | |
|---|---|---|
| GB | 999507 | 7/1965 |
| JP | 64-060704 A | 3/1989 |
| JP | 05-061402 U | 8/1993 |
| JP | 05-075403 U | 10/1993 |

OTHER PUBLICATIONS

U.S. Appl. No. 13/332,534, Filed Dec. 21, 2011.

* cited by examiner

*Primary Examiner* — Zelalem Eshete
(74) *Attorney, Agent, or Firm* — Liell & McNeil

(57) ABSTRACT

An internal combustion engine includes a housing defining a lifter bore, and a slot in communication with the lifter bore. A valve lifter assembly is positioned within the lifter bore such that a key pin of the valve lifter assembly extends into the slot. The key pin has a contoured outer surface contacting the engine housing within the slot at a first and a second rotational orientation of the valve lifter, to limit misalignment thereof.

20 Claims, 3 Drawing Sheets

INTERNAL COMBUSTION ENGINE HAVING VALVE LIFTER ASSEMBLY WITH MISALIGNMENT LIMITING KEY PIN

TECHNICAL FIELD

The present disclosure relates generally to strategies for limiting rotational misalignment of a reciprocating valve lifter in an internal combustion engine, and more particularly to contacting an engine housing with a key pin in a valve lifter assembly to limit rotational misalignment thereof.

BACKGROUND

Valve lifters are used in internal combustion engines to convert rotational motion of an engine cam into linear motion, for controlling the position of gas exchange valves. A typical design includes a lifter body coupled with a pushrod configured to actuate a rocker arm of one or more gas exchange valves. The lifter body includes a roller positioned in contact with the engine cam, such that rotation of the engine cam causes the valve lifter to slide within a lifter bore formed in the engine housing. Sliding of the valve lifter adjusts the pushrod, which in turn moves the rocker arm in a well-known manner.

In certain designs, the roller may be generally cylindrical and contacts an outer surface of the cam, such that a desired interface between the roller and the cam outer surface is essentially linear. During service in the engine, valve lifters may become misaligned with the cam via rotation of the valve lifter within the lifter bore. The causes of such misalignment appear to vary from engine to engine. Even seemingly identical engine designs can exhibit different misalignment issues of their valve lifters over the course of the engine's service life. Adding to the complexity, some valve lifters tend to rotate more, or differently than other valve lifters even within the same engine.

Various strategies have been proposed over the years to limit rotation of valve train components. One technique employs an anti-rotation device received in an aperture formed in a skirt of a valve train tappet, such as that taught in U.S. Pat. No. 7,210,437 to Geyer. In Geyer, the anti-rotation device is mushroom-shaped and has a rectangular portion received in a rectangular aperture in the tappet. Geyer proposes preventing rotation of the tappet via guidance of the anti-rotation device in a groove intersecting a guide bore for the tappet. The design purportedly prevents radially inward excursions of the anti rotation device during service. While Geyer may achieve its stated purposes, it is not without drawbacks, and appears purpose-built to solve problems which may be specific to certain engine designs or duty cycles.

SUMMARY

In one aspect, an internal combustion engine includes an engine housing having a head side and an opposite crank side, and defining a lifter bore extending longitudinally between the head side and the crank side, and a slot in communication with the lifter bore. The engine further includes a camshaft rotatably mounted to the engine housing and including an engine cam, and a valve lifter assembly positioned within the lifter bore and including a valve lifter defining a longitudinal axis, a lifter roller in contact with the engine cam, for reciprocating the valve lifter within the lifter bore, and a key pin coupled to the valve lifter. The valve lifter includes a planar peripheral face, and defines a transverse bore extending radially inward from the planar peripheral face. The key pin includes a shank held fast within the transverse bore, and an outwardly projecting head having a first and a second longitudinal edge, and a contoured outer surface. The contoured outer surface includes a plateau, and a first and a second slope descending from the plateau to the first and the second longitudinal edge, respectively. The contoured outer surface is positioned within the slot such that the first and second slopes respectively contact the engine housing at a first and a second rotational orientation of the valve lifter, to limit misalignment thereof.

In another aspect, a valve lifter assembly for an internal combustion engine includes a valve lifter including an elongate one-piece lifter body having a pushrod bore formed therein, and having a longitudinal axis extending between a proximal body segment defining an opening to the pushrod bore, and a distal body segment configured to receive a lifter roller. The proximal body segment has a planar peripheral face formed thereon, and defines a transverse bore extending inwardly from the planar peripheral face. The valve lifter assembly further includes a key pin having a shank held fast within the transverse bore, and an outwardly projecting head having a contoured outer surface, the contoured outer surface having a plateau, and a first and a second slope descending from the plateau to a first and a second longitudinal edge of the outwardly projecting head. The contoured outer surface is positionable within a slot adjoining a lifter bore receiving the valve lifter in an engine housing of the internal combustion engine, such that the first and second slopes respectively contact the engine housing at a first and a second rotational orientation of the valve lifter, to limit misalignment thereof.

In another aspect, a key pin is provided, for limiting misalignment of a reciprocating valve lifter in an engine housing of an internal combustion engine, where the engine housing defines a valve lifter bore receiving the valve lifter and a semi-circular slot adjoining the valve lifter bore. The key pin includes a cylindrical shank defining a shank axis extending between a first shank end and a second shank end, the second shank end having a tapered tip for interference fitting the shank into a transverse bore formed in the valve lifter. The key pin further includes a head adjoining the second shank end, and having a planar inner surface extending radially outward from the first shank end to a plurality of outer edges of the head forming a rectangular pattern about the shank axis. The head further includes a contoured outer surface extending between a first and a second end surface, the first and second end surfaces adjoining the planar inner surface at a first and a second of the outer edges each having a shorter length, and the contoured outer surface adjoining the planar inner surface at a third and a fourth of the outer edges each having a longer length. The contoured outer surface includes a plateau oriented parallel to the planar inner surface, and a first and a second slope descending from the plateau to the third and fourth outer edges, and each of the first and second slopes having a convex curving shape between the plateau and the corresponding outer edge, such that the first and second slopes each form a line pattern of contact with the engine housing within the semi-circular slot at a first and a second rotational orientation of the valve lifter, to limit its misalignment within the valve lifter bore.

DETAILED DESCRIPTION

Figure 1:
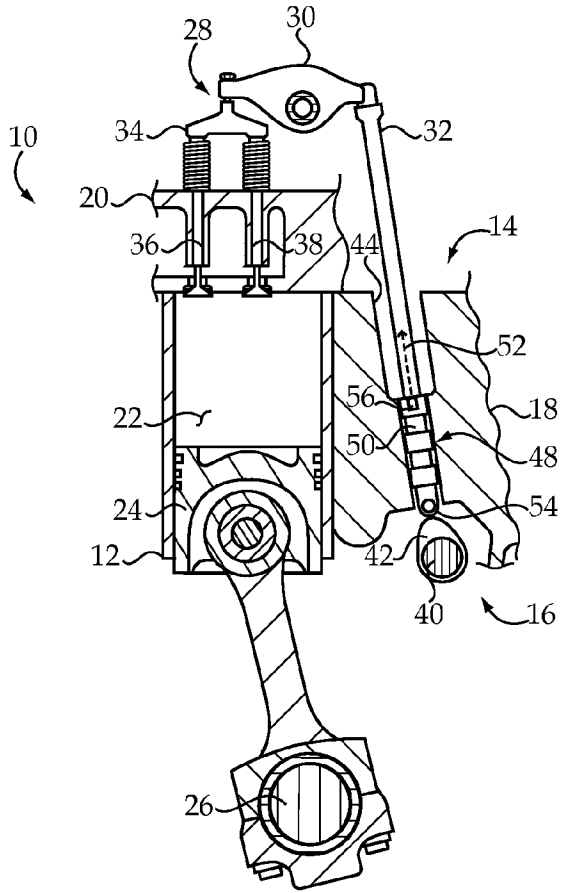
FIG. 1 is a sectioned side diagrammatic view of a portion of an internal combustion engine, according to one embodiment.

Referring to FIG. 1, there is shown an internal combustion engine 10 according to one embodiment. Engine 10 may be a direct injection compression ignition engine, and includes an engine housing 12 having a head side 14, and an opposite crank side 16. Housing 12 may include a cylinder block 18 and an engine head 20 coupled to cylinder block 18 in a conventional manner. Cylinder block 18 defines a cylinder 22, and in a practical implementation strategy may define a plurality of cylinders. A piston 24 is positioned within cylinder 22 and reciprocates in a conventional manner in response to combustion of a mixture of fuel, such as a diesel distillate fuel, and air within cylinder 22. Piston 24 is coupled with a crankshaft 26 positioned upon crank side 16 of engine housing 12 to rotate in a conventional manner. Engine 10 may also include a plurality of gas exchange valves 36 and 38 such as intake valves or exhaust valves, associated with cylinder 22 in a conventional manner. Gas exchange valves 36 and 38 may be coupled to a bridge 34 of a rocker arm assembly 28 having a rocker arm 30, and a pushrod 32. As will be familiar to those skilled in the art, rocker arm assembly 28 functions to actuate gas exchange valves 36 and 38, alternately opening fluid communication and closing fluid communication between cylinder 22 and a fluid conduit formed in engine head 20. An additional rocker arm assembly and an additional two gas exchange valves may also be associated with cylinder 22 such that cylinder 22 is associated with two intake valves and two exhaust valves, although the additional valves are not shown in FIG. 1.

Engine housing 12 may further define a lifter bore 44 extending longitudinally between head side 14 and crank side 16, and a slot in communication with lifter bore 44 which is not visible in FIG. 1 and to be described hereinafter. A camshaft 40 is rotatably mounted to engine housing 12 and includes an engine cam 42. A valve lifter assembly 48 is positioned within lifter bore 44 and includes a valve lifter 50 defining a longitudinal axis 52, a lifter roller 54 in contact with engine cam 42, for reciprocating valve lifter 50 within lifter bore 44, and a key pin 56 coupled to valve lifter 44. As will be further apparent from the following description key pin 56, which cooperates with the aforementioned slot, functions to limit misalignment of valve lifter 50 during service in engine 10, preventing excessive wear, premature failure, and offering other advantages over known strategies for limiting misalignment of valve lifters in an internal combustion engine.

Figure 2:
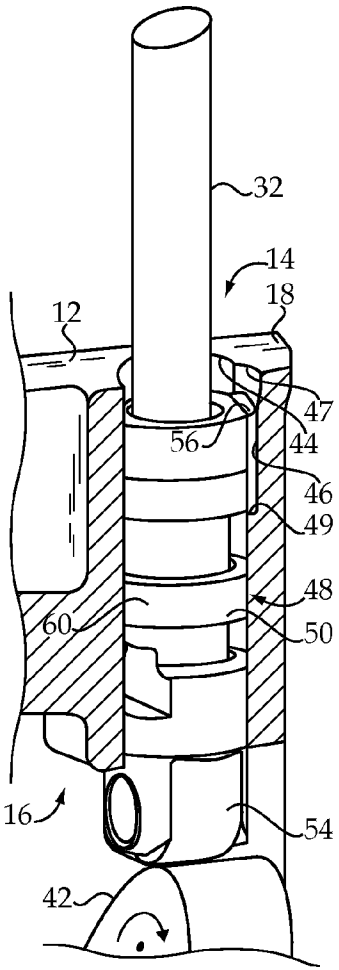
FIG. 2 is a partially sectioned side diagrammatic view of a portion of the engine of FIG. 1.

Referring also now to FIG. 2, there is shown a partially sectioned view illustrating valve lifter assembly 48 positioned within engine housing 12 in more detail. Valve lifter 50 includes an elongate one-piece lifter body 60 which reciprocates in lifter bore 44 in response to rotation of cam 42. In particular, valve lifter 50 may be moved from a first position to an advanced position within lifter bore 44, pushing upwardly on pushrod 32 to rotate rocker arm 30, and urge gas exchange valves 36 and 38 toward an open position. When cam 42 is not acting to raise valve lifter 50 in this manner, return springs of rocker arm assembly 28 can counter-rotate rocker arm 30, and urge pushrod 32 downward to bias valve lifter 50 toward its first position. As mentioned above, engine housing 12 defines a slot 46 adjoining lifter bore 44, and key pin 56 reciprocates within slot 46. In a practical implementation strategy, slot 46 may be semi-circular, although other arcuate configurations are contemplated herein. Slot 46 may extend from a first, open slot end 47 positioned at head side 14 to a second, closed end 49 positioned between head side 14 and crank side 16. Slot 46 might be formed in housing 12 by drilling a circular bore part-way through the casting or the like which forms cylinder block 18. Lifter bore 44 may be similarly formed, but by drilling a circular bore all the way through cylinder block 18, and partially overlapping with the pre-existing partial depth bore to thereby form both lifter bore 44 and slot 46. In alternative manufacturing strategies, bore 44 might be formed first, and then slot 46 formed via broaching or another suitable technique.

Figure 3:
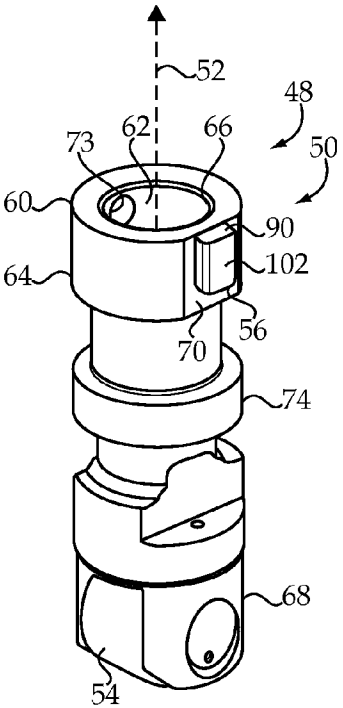
FIG. 3 is a diagrammatic view of a valve lifter assembly according to one embodiment.

Referring also now to FIG. 3, there are shown still further features of valve lifter assembly 48 in a diagrammatic view. Lifter body 60 may have a pushrod bore 62 formed therein, and longitudinal axis 52 may extend between a proximal body segment 64 defining an opening 66 to pushrod bore 62, and a distal body segment 68 configured to receive a lifter roller. In the illustrated embodiment, a generally cylindrical lifter roller 54 is shown positioned at least partially within distal segment 68. A middle body segment 74 may be positioned between proximal body segment 64 and distal body segment 68, and in certain embodiments may be configured to guide lifter body 60 during reciprocating within lifter bore 44. Proximal body segment 64 may further include a planar peripheral face 70 formed thereon. Proximal body segment 64 may also define a transverse bore extending inwardly from planar peripheral face 70 and receiving key pin 56. In FIG. 3, the subject transverse bore is obscured by key pin 56, but an opposite transverse bore 73 is visible. In certain embodiments, two transverse bores, each communicating with pushrod bore 62, may be formed in proximal body segment 64 to enable key pin 56 to be positioned at either of two locations on proximal body segment 64. A planar peripheral face such as face 70 might also be formed at either of the two different locations upon proximal body segment 64.

Figure 4:
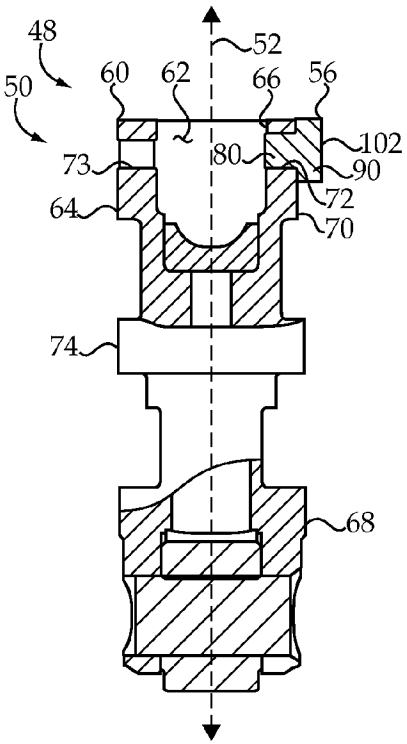
FIG. 4 is a partially sectioned side diagrammatic view of the valve lifter assembly of FIG. 3.

Referring also now to FIG. 4, there is shown a sectioned view of valve lifter assembly 48 and illustrating still further details thereof. As mentioned above, body 60 may, within proximal body segment 64, define a transverse bore extending inwardly from planar peripheral face 70. This transverse bore is identified via reference numeral 72 in FIG. 4. Key pin 56 may include a shank 80, such as a cylindrical shank, held fast within transverse bore 72, for example via an interference fit. Key pin 56 may also include an outwardly projecting head 90 having a contoured outer surface 102, the shape of which may be configured to cooperate with slot 46 in a manner further described herein to limit misalignment of valve lifter 50 within lifter bore 44.

Figure 5:
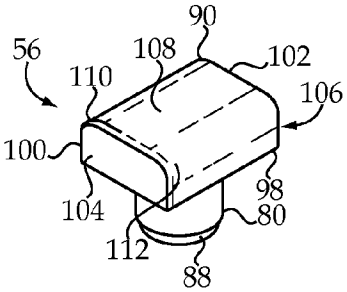
FIG. 5 is a pictorial view of a key pin suitable for use in the valve lifter assembly of FIGS. 3 and 4.
Figure 6:
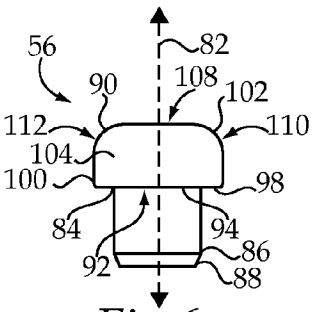
FIG. 6 is a side diagrammatic view of the key pin of FIG. 5.
Figure 7:
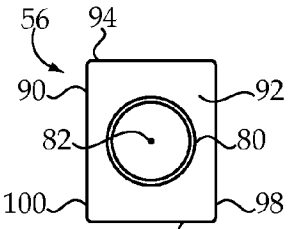
FIG. 7 is a bottom elevational view of the key pin of FIGS. 5 and 6.

Referring also now to FIGS. 5, 6 and 7, there are shown several views of key pin 56 illustrating additional features thereof. As noted above, shank 80 may be cylindrical, and may further define a shank axis 82 extending between a first shank end 84 and a second shank end 86. Second shank end 86 may have a tapered tip 88, for interference fitting shank 80 into transverse bore 72, or alternatively transverse bore 73. Head 90 may also include a planar inner surface 92 extending radially outward from first shank end 84 to a plurality of outer edges of head 90 forming a rectangular pattern about shank axis 82. The plurality of outer edges may include a first and a second outer edge 94 and 96, each having a shorter length, and a third and a fourth outer edge 98 and 100 each having a longer length. Contoured outer surface 102 may extend between a first end surface 104 and a second end surface 106 of head 90. First and second end surfaces 104 and 106 adjoin planar inner surface 92 at first and second outer edges 94 and 96, respectively. Contoured outer surface 102 adjoins planar inner surface 92 at third and fourth outer edges 98 and 100. In a practical implementation strategy, each of first and second end surfaces 104 and 106 may be planar, and parallel to one another. Contoured outer surface 102 may extend from first end surface 104 to second end surface 106, and may define a uniform profile from first end surface 104 to second end surface 106. When key pin 56 is interference fitted and thereby coupled to valve lifter 50, third and fourth outer edges 98 and 100 may be oriented longitudinally, in other words the edges forming the intersections between the adjoining surfaces may define lines which are generally parallel to longitudinal axis 52 of valve lifter 50. First and second outer edges 94 and 96 may extend between third and fourth longitudinal/outer edges 98 and 100 to form the subject rectangular pattern.

In FIG. 7, it may be noted that shank axis 82 extends into and out of the page, and a geometric center point of head 90 is located on shank axis 82, such that shank 80 is centered on the geometric centerpoint and surrounded by inner surface 92. In a practical implementation strategy, shank 80 may have an axial length, also extending into and out of the page in FIG. 7, and visible in side view in FIG. 6, from about 4 mm to about 5 mm. As used herein, the term "about" may be understood in the context of rounding to a consistent number of significant digits. Accordingly, about 4 mm means from 3.5 mm to 4.4 mm, and so on. An outer diameter dimension of shank 80, which would be understood to be oriented normal to shank axis 82, may be equal to or greater than the axial length of shank 80. Shank 80 may be hidden within valve lifter 50 when interference fitted within transverse bore 72. In other words, shank 80 may extend from planar peripheral face 70 to the inner wall forming pushrod bore 66, but will typically not extend further inward or further outward. First and second outer edges 94 and 96 may have lengths equal to about 4 mm, and third and fourth outer edges 98 and 100 may have lengths equal to about 5 mm.

As mentioned above, contoured outer surface 102 may be shaped to cooperate with slot 46, which may be semi-circular. To this end, contoured outer surface 102 may include a plateau 108 oriented parallel to planar inner surface 92, and a first and a second slope 110 and 112 descending from plateau 108 to third and fourth outer edges 98 and 100, respectively. Each of first and second slopes 110 and 112 may have a convex curving shape between plateau 108 and the corresponding outer edge 98 and 100, such that slopes 110 and 112 each form a line pattern of contact with engine housing 12, and in particular the surface of engine housing 12 forming slot 46, at a first and a second rotational orientation of valve lifter 50, to limit its misalignment within lifter bore 44. In a practical implementation strategy, each of first and second slopes 110 and 112 defines a radius equal to about 2 mm. Each of first and second slopes 110 and 112 may further transition from the convex curving shape to a flat shape at locations adjoining third and fourth outer edges 98 and 100. This geometry is perhaps best represented in FIG. 6, where it can be seen that planar inner surface 92, plateau 108, end surfaces 104 and 106, and slopes 110 and 112 define a shape having the form of a rectangular box. In one embodiment, the subject line pattern of contact may be understood to be enabled by the interfacing of smaller radiuses, those defined by slopes 110 and 112, with a larger radius, that defined by slot 46. In contrast to the line contact pattern, inner surface 92 may be understood to abut planar peripheral face 70 according to a two-dimensional pattern of contact when key pin 56 is assembled with lifter body 60. An engagement length of contact between head 90 and engine housing 12 may be equal to about 10 mm in certain embodiments.

INDUSTRIAL APPLICABILITY

Figure 8:
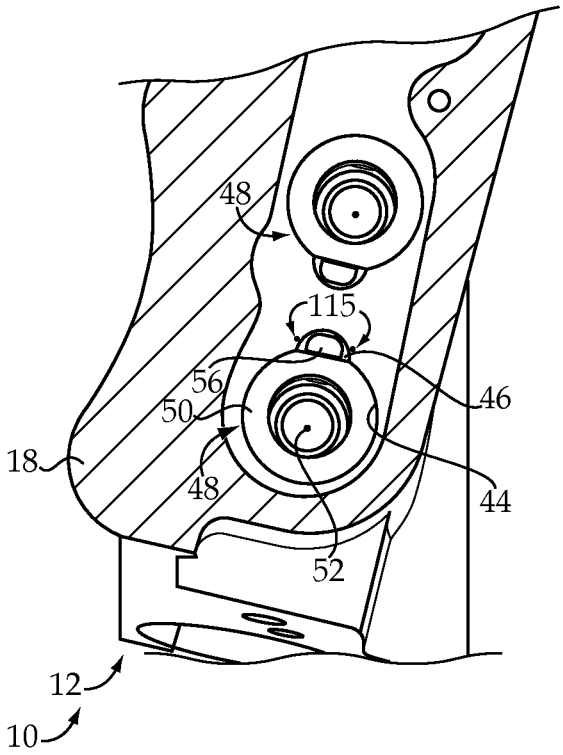
FIG. 8 is a diagrammatic view of adjacent valve lifter assemblies positioned for service within an internal combustion engine, according to one embodiment.

Referring to the drawings generally, but in particular now to FIG. 8, there is shown a top view of two adjacent valve lifter assemblies 48 and 48' as they might appear when positioned for service in cylinder block 18, but not coupled with rocker arm assemblies. Valve lifter assembly 48 might be used to actuate one or more intake valves for a cylinder in engine 10, whereas valve lifter assembly 48' might be used to actuate one or more exhaust valves for the same cylinder. Accordingly, valve lifter assemblies 48 and 48' will be understood to reciprocate out of phase with one another in a practical implementation strategy, although the present description should otherwise be understood to refer similarly to each. It will be recalled that key pin 56 acts to limit misalignment of the corresponding valve lifter 50 via contacting the engine housing, in the illustrated case of FIG. 8 cylinder block 18, at first and second rotational orientations of valve lifter 50. It may be noted that in FIG. 8 key pin 56 is not in contact with cylinder block 18 at all. The orientation shown might be an orientation where the corresponding lifter roller 54 is at a desired state of alignment with engine cam 42.

It has long been observed that engine dynamics can induce rotation of valve lifter assemblies within their lifter bores in an internal combustion engine. As noted above, many different strategies have been proposed over the years for limiting such rotation. Certain known strategies attempt to severely limit rotation of valve lifter assemblies. It has been observed that scuffing, scratching, or other wear related phenomena, as well as problems with tolerance stack-ups, can result in such designs, ultimately limiting valve lifter service life or causing assembly and/or functional problems. Other strategies permit relatively more rotation, but can suffer from the downsides of complicating load paths and dynamics of the overall system, potentially leading to new problems.

By providing for a line pattern of contact between key pin 56 and engine housing 12 at two different rotational orientations of value lifter 50, some rotation may be permitted without unduly affecting the overall dynamic behavior of the system or causing wear-related issues. In FIG. 8, a clearance extends between key pin 56 and engine housing 12, and a first and a second contact point, each shown via reference numeral 115, reside where slopes 110 and 112 of key pin 56 can be expected to contact housing 12 at first and second rotational orientations of valve lifter 50 about its axis 52. An angle about axis 52 between points 115 may be about 10°, or less, and may be about 5°, or less, in certain embodiments. Thus, valve lifter 50 may be expected to rotate back and forth relatively modestly between points 115 in response to engine dynamics, permitting valve lifter 50 to rotate away from a desired pattern of contact between lifter roller 54 and cam 42 to an undesired pattern of contact, but then rotating back to the desired pattern of contact when dynamic forces inducing the rotation subside or are negated. The shape of cam 42 and lifter roller 54, plus the force of a return spring in the associated rocker arm assembly enables valve lifter 50 to be self-aligning when no external perturbing force induces its rotation. Due to the shape of contoured outer surface 102, the patterns of contact between slopes 110 and 112 and engine housing 12 may define lines, as noted, based upon the different sizes of the radiuses of the interfacing components, while a clearance between plateau 108 and engine housing 12 tends to be maintained regardless of rotation of valve lifter 50.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. An internal combustion engine comprising:

an engine housing having a head side and an opposite crank side, and defining a lifter bore extending longitudinally between the head side and the crank side, and a slot in communication with the lifter bore;

a camshaft rotatably mounted to the engine housing and including an engine cam;

a valve lifter assembly positioned within the lifter bore and including a valve lifter defining a longitudinal axis, a lifter roller in contact with the engine cam, for reciprocating the valve lifter within the lifter bore, and a key pin coupled to the valve lifter;

the valve lifter having a planar peripheral face, and defining a transverse bore extending radially inward from the planar peripheral face, and the key pin having a shank held fast within the transverse bore, and an outwardly projecting head having a first and a second longitudinal edge, and a contoured outer surface; and the contoured outer surface having a plateau, and a first and a second slope descending from the plateau to the first and the second longitudinal edge, respectively, and the contoured outer surface being positioned within the slot such that the first and second slopes respectively contact the engine housing at a first and a second rotational orientation of the valve lifter, to limit misalignment thereof, and wherein the valve lifter is positioned at the first rotational orientation and the first slope contacts the engine housing in a line pattern of contact.

2. The internal combustion engine of claim 1 wherein the first and second slopes form a line pattern of contact with the engine housing at each of the first and second rotational orientations, and wherein the outwardly projecting head further includes an inner surface abutting the planar peripheral face and having a two-dimensional pattern of contact therewith.

3. The internal combustion engine of claim 2 wherein the slot has a semi-circular shape defining a larger radius, and each of the first and second slopes has a convex curving shape defining a smaller radius.

4. The internal combustion engine of claim 3 wherein the plateau is oriented parallel to the inner surface, and a clearance extends between the plateau and the engine housing at each of the first and second rotational orientations of the valve lifter.

5. The internal combustion engine of claim 4 wherein the outwardly projecting head further includes a first and a second end surface, each adjoining the inner surface and the contoured outer surface, and the contoured outer surface has a uniform profile from the first to the second end surface.

6. The internal combustion engine of claim 1 wherein the slot extends from an open end positioned at the head side of the engine housing to a closed end positioned between the head and crank sides of the engine housing.

7. The internal combustion engine of claim 1 further comprising a gas exchange valve for a cylinder formed in the engine housing and being coupled with the valve lifter assembly, and wherein the valve lifter is movable within the lifter bore from a first position to an advanced position in response to rotation of the engine cam to adjust the gas exchange valve between a closed and an open position, respectively, and the key pin is within the slot at each of the first and advanced positions.

8. The internal combustion engine of claim 7 wherein the valve lifter defines a pushrod bore receiving a pushrod coupled with a rocker arm for the gas exchange valve, and includes a proximal segment having an opening to the pushrod bore formed therein, a middle segment, and a distal segment having the lifter roller rotatably mounted therein, and wherein the planar peripheral face is located on the proximal segment.

9. The internal combustion engine of claim 7 wherein the valve lifter assembly is limited in rotation within the lifter bore via the contact to a range of about 5° or less from the first to the second rotational positions.

10. A valve lifter assembly for an internal combustion engine comprising:

a valve lifter including an elongate one-piece lifter body having a pushrod bore formed therein and having a longitudinal axis extending between a proximal body segment defining an opening to the pushrod bore, and a distal body segment configured to receive a lifter roller;

the proximal body segment having a planar peripheral face formed thereon, and defining a transverse bore extending inwardly from the planar peripheral face;

a key pin having a shank held fast within the transverse bore, and an outwardly projecting head having a first and a second end surface and a contoured outer surface extending in a longitudinal direction parallel the longitudinal axis from the first end surface to the second end surface, the contoured outer surface having a plateau, and a first and a second slope descending from the plateau to a first and a second parallel longitudinal edge of the outwardly projecting head; and the contoured outer surface being positionable within a slot adjoining a lifter bore receiving the valve lifter assembly in an engine housing of the internal combustion engine, such that the first and second slopes respectively contact the engine housing at a first and a second rotational orientation of the valve lifter, to limit misalignment thereof, and the first and second slopes having uniform longitudinal profiles from the first end surface to the second end surface such that the contact forms a line pattern at each of the first and second rotational orientations.

11. The valve lifter assembly of claim 10 wherein the shank is cylindrical, and held fast within the transverse bore via an interference fit, and wherein the outwardly projecting head includes an inner surface having a geometric center point, and the shank is centered on the geometric center point and surrounded by the inner surface.

12. The valve lifter assembly of claim 11 wherein the outwardly projecting head further includes a first and a second side edge each extending between the first and second longitudinal edges to form a rectangular pattern.

13. The valve lifter assembly of claim 12 wherein the inner surface extends from the first to the second end surface.

14. The valve lifter assembly of claim 13 wherein the contoured outer surface defines a uniform profile from the first to the second end surface.

15. The valve lifter assembly of claim 14 wherein the first and second end surfaces are planar and parallel to one another.

16. The valve lifter assembly of claim 14 wherein the plateau is oriented parallel to the inner surface, and the first and second slopes each having a convex curving shape, for forming the line pattern of contact with a semi-circular surface of the engine housing defining the slot.

17. A key pin for limiting misalignment of a reciprocating valve lifter in an engine housing of an internal combustion engine, where the engine housing defines a valve lifter bore receiving the valve lifter and a semi-circular slot adjoining the valve lifter bore, the key pin comprising:

a cylindrical shank defining a shank axis extending between a first shank end and a second shank end, the second shank end having a tapered tip for interference fitting the shank into a transverse bore formed in the valve lifter;

a head adjoining the second shank end, and including a planar inner surface extending radially outward from the first shank end to a plurality of outer edges of the head forming a rectangular pattern about the shank axis;

the head further including a contoured outer surface extending between a first and a second end surface, the first and second end surfaces adjoining the planar inner surface at a first and a second of the outer edges each having a shorter length, and the contoured outer surface adjoining the planar inner surface at a third and a fourth of the outer edges each having a longer length; and the contoured outer surface including a plateau oriented parallel to the planar inner surface, and a first and a second slope descending from the plateau to the third and fourth outer edges, and each of the first and second slopes having a convex curving shape between the plateau and the corresponding outer edge which is uniform in profile from the first end surface to the second end surface, such that the first and second slopes each define line segments extending between the first and second end surfaces and oriented parallel the corresponding outer edges, and form a line pattern of contact with the engine housing within the semi-circular slot at a first and a second rotational orientation of the valve lifter, to limit its misalignment within the valve lifter bore.

18. The key pin of claim 17 wherein the cylindrical shank has an axial length from about 4 mm to about 5 mm, and an outer diameter dimension which is equal to or greater than the axial length.

19. The key pin of claim 18 wherein the first and second outer edges have lengths equal to about 4 mm, the third and fourth outer edges have lengths equal to about 5 mm, and each of the first and second slopes defines a radius equal to about 2 mm.

20. The key pin of claim 17 wherein the first and second end surfaces are planar, and each of the first and second slopes transitions from the convex curving shape to a flat shape at locations adjoining the third and fourth outer edges, such that the planar inner surface, the plateau, the first and second end surfaces, and the first and second slopes, define a shape having the form of a rectangular box.

* * * * *